US011375780B2

(12) United States Patent
Nolan, Jr.

(10) Patent No.: US 11,375,780 B2
(45) Date of Patent: Jul. 5, 2022

(54) SYSTEM, METHOD AND APPARATUS FOR NECKLACE PENDANT

(71) Applicant: All Star Motivation.com, Las Vegas, NV (US)

(72) Inventor: William P. Nolan, Jr., Las Vegas, NV (US)

(73) Assignee: All Star Motivation.com, Las Vegas, NV (US)

( * ) Notice: Subject to any disclaimer, the term of this patent is extended or adjusted under 35 U.S.C. 154(b) by 0 days.

(21) Appl. No.: 16/741,298

(22) Filed: Jan. 13, 2020

(65) Prior Publication Data

US 2020/0221832 A1 Jul. 16, 2020

Related U.S. Application Data

(60) Provisional application No. 62/792,229, filed on Jan. 14, 2019.

(51) Int. Cl.
*A44C 25/00* (2006.01)
*A44C 15/00* (2006.01)

(52) U.S. Cl.
CPC ..... *A44C 25/002* (2013.01); *A44C 15/002* (2013.01); *A44C 15/005* (2013.01)

(58) Field of Classification Search
CPC ... A44C 15/002; A44C 25/002; A44C 25/003; E05D 3/06; E05D 3/12; B65D 55/16; B65D 35/42; B65D 43/20; B65D 43/16; B65D 21/086
USPC ..... 220/375, 8, 811, 810; 222/543; 215/306
See application file for complete search history.

(56) References Cited

U.S. PATENT DOCUMENTS 252,059 A * 1/1882 Rich ..... B65D 55/16 215/238
563,974 A * 7/1896 Lacavalerie ..... B65D 55/16 215/238
834,679 A * 10/1906 Newton ..... B65D 55/16 215/243
1,296,742 A * 3/1919 Bevington ..... B65D 21/086 220/8
1,440,925 A * 1/1923 McComas ..... B65D 55/16 220/285

(Continued)

FOREIGN PATENT DOCUMENTS

DE 102004025288 A1 * 12/2005 ..... B65F 1/16
FR 650144 A * 1/1929 ..... A44C 15/002

*Primary Examiner* — Emily M Morgan
(74) *Attorney, Agent, or Firm* — Dickinson Wright, PLLC; Michael E. Noe, Jr.; Christopher A. Mitchell

(57) ABSTRACT

A pendant for a necklace has a body with an aperture, and a hole extending into the body from the aperture. The hole terminates at a closed bottom in the body. A body coupling is adjacent the aperture. A lid can be attached to and detached from the body. The lid also can be mounted to the necklace to support the body therefrom. The lid has a lid coupling to couple to the body coupling to close the aperture. The lid coupling can be uncoupled from the body coupling to provide access to the hole. A container is removably mounted in the body. The container has a retained position where the container is in the hole in the body when the lid is mounted to the body. The container also has a released position with the lid detached such that the container is at least partially exposed from the body.

12 Claims, 11 Drawing Sheets

(56) References Cited

U.S. PATENT DOCUMENTS 1,681,743 A * 8/1928 Peterson ..... B65D 35/42 220/817
1,743,046 A * 1/1930 Joseph ..... B65D 55/16 215/235
2,324,441 A * 7/1943 Brocklin ..... B65D 35/42 220/291
2,763,394 A * 9/1956 Meek ..... B05B 11/00 220/8
3,799,426 A * 3/1974 Pates ..... B65D 17/02 229/4.5
4,023,712 A * 5/1977 Babiak ..... A44C 25/002 222/175
4,964,570 A 10/1990 Haiduk
D409,830 S * 5/1999 Stafford ..... D3/208
6,378,173 B1 * 4/2002 Ho ..... E05D 3/12 16/366
6,644,513 B1 * 11/2003 Nesbitt ..... A44C 25/002 222/175
7,048,203 B2 5/2006 Harada et al.
7,101,442 B2 * 9/2006 Choi ..... H01L 21/67126 118/733
D630,010 S * 1/2011 Brown ..... D3/208
8,082,754 B2 12/2011 Kazazian
D658,073 S * 4/2012 Lee ..... D9/691
D691,063 S * 10/2013 Torregrossa ..... D11/79
D783,268 S * 4/2017 Shelton ..... D3/208
2005/0044664 A1 * 3/2005 Chang ..... H04N 1/00543 16/327
2005/0264144 A1 * 12/2005 Verbeek ..... E05F 1/1091 312/323
2008/0189906 A1 * 8/2008 Resnik ..... E05F 3/108 16/54
2008/0237237 A1 * 10/2008 Watson ..... H05K 5/0278 220/375
2015/0176316 A1 * 6/2015 Tschap ..... E05D 3/12 16/277
2016/0082140 A1 3/2016 Chen
2016/0316887 A1 * 11/2016 Maehr ..... A44C 1/00
2017/0295893 A1 10/2017 D'Alessandro
2017/0354213 A1 * 12/2017 Feng ..... A44C 15/002
2019/0350321 A1 * 11/2019 Merritt ..... A44C 5/003
2019/0364682 A1 * 11/2019 Kikuchi ..... G06F 1/1618
2021/0040786 A1 * 2/2021 Heimbach ..... B60R 7/02

* cited by examiner

FIG. 14
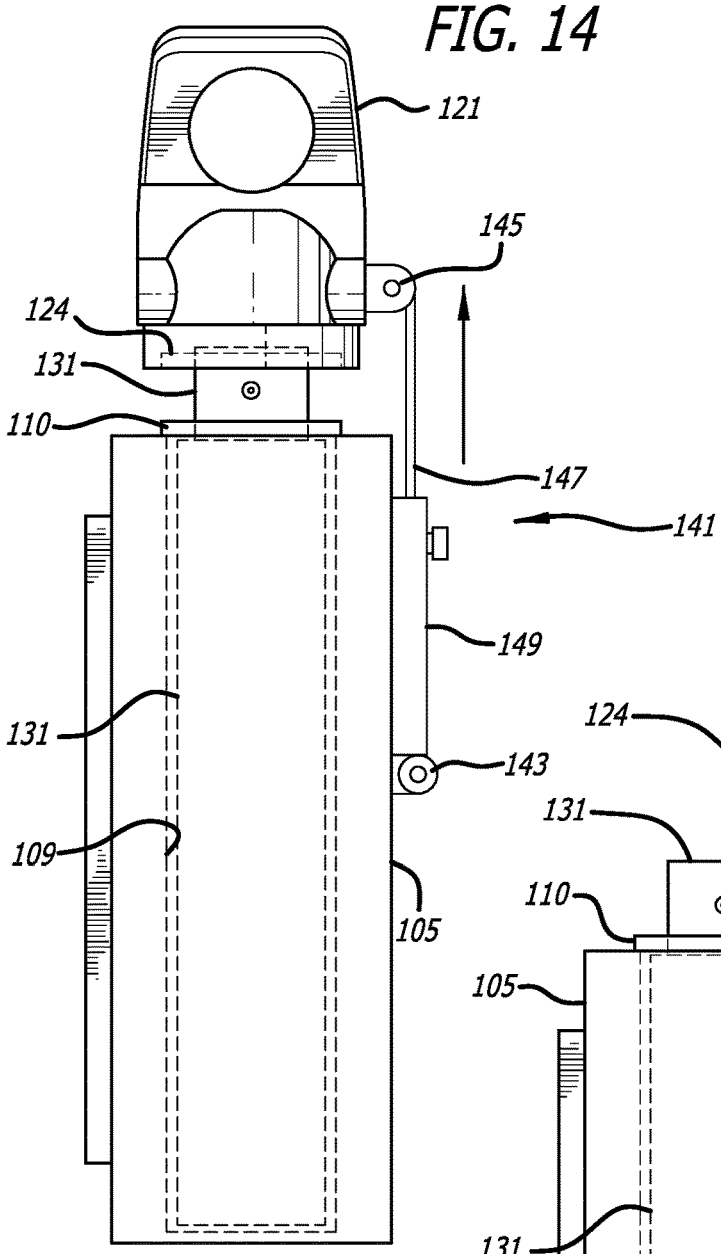
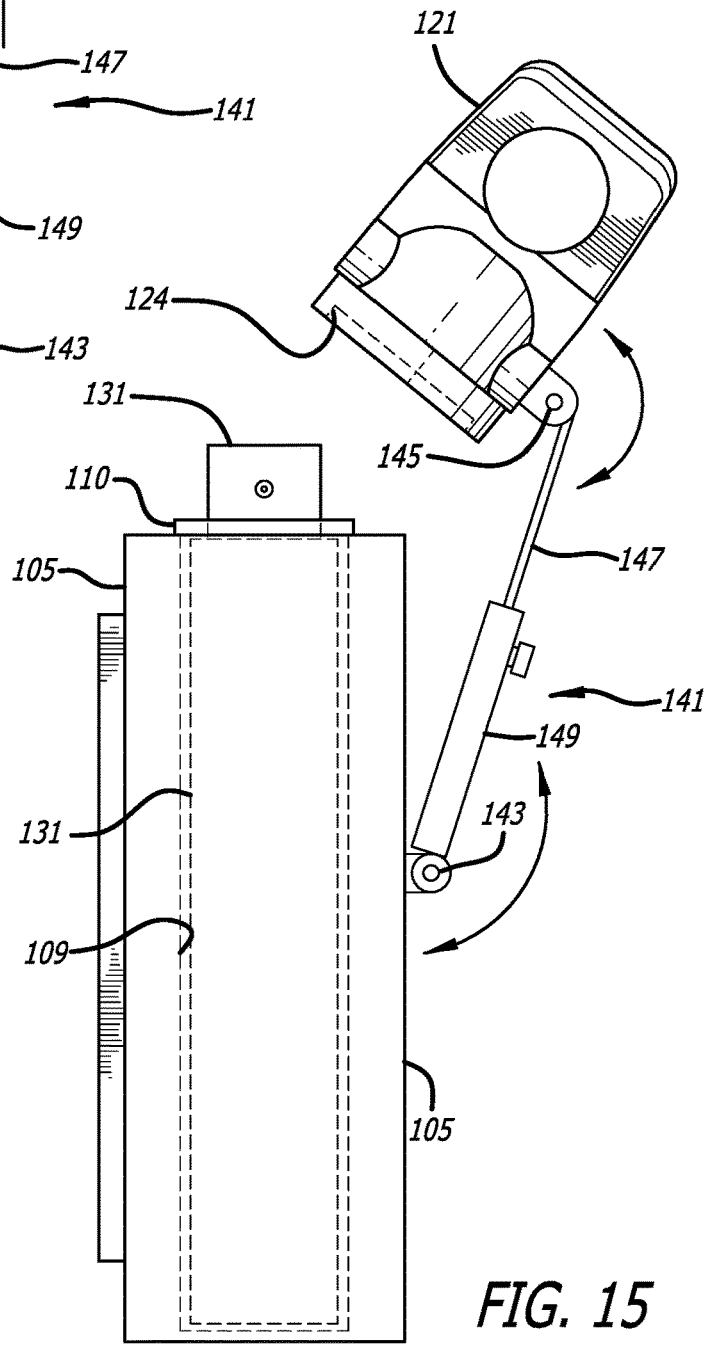
FIG. 15

SYSTEM, METHOD AND APPARATUS FOR NECKLACE PENDANT

CROSS-REFERENCE TO RELATED APPLICATION

This application claims priority to and the benefit of U.S. Prov. Pat. App. No. 62/792,229, filed Jan. 14, 2019, which is incorporated herein by reference in its entirety.

TECHNICAL FIELD

This application generally relates to a pendant and, in particular, to a necklace pendant having a hidden, deployable container for a fluid.

STATEMENT OF FEDERALLY FUNDED RESEARCH

None.

BACKGROUND

A variety of devices has been developed to employ personal jewelry as a mechanism for transporting and/or dispensing perfume or cologne. For example, some designs use jewelry to carry fragrance whose odor permeates the jewelry. These designs do not permit the jewelry to be recharged with the fragrance.

Other designs disclose fragrance holders such as a lipstick case, a vanity case, and a ring. The fragrance holding material is concealed within a compartment covered by an ornamental piece having openings through which the fragrance may pass. The openings can be adjustable to regulate the intensity of the fragrance to be produced. A similar design discloses an ear ring with a compartment for containing a pad to carry the perfume.

Another type of perfume dispenser microencapsulates the fragrance and the capsules are dispensed with a tape material. The capsules are crushed as they are dispensed. This arrangement can reduce loss of the highly volatile perfume through evaporation. Although these devices are suitable for some applications, improvements in pendants with fragrance options continue to be of interest.

SUMMARY

Embodiments of a necklace pendant having a deployable container for a fluid are disclosed. For example, a pendant for a necklace can include a body having an aperture, and a hole extending into the body from the aperture. The hole can terminate at a closed bottom within the body. A body coupling can be located adjacent to the aperture. In some versions, a lid can be configured to be attached to and detached from the body. The lid also can be configured to be mounted to the necklace to support the body therefrom. The lid can include a lid coupling configured to be coupled to the body coupling to close the aperture. The lid coupling can be configured to be uncoupled from the body coupling to provide access to the hole.

In addition, a container can be configured to be removably mounted in the body. The container can have a retained position wherein the container is seated on the closed bottom of the hole and captured inside the body by the lid when the lid is mounted to the body. In this position, the container can be configured to not dispense fluid. The container also can have a released position wherein the lid is detached from the body such that the container is at least partially exposed from the body. In this position, the container can be configured to dispense fluid.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description can be had by reference to the versions illustrated in the drawings. However, the drawings illustrate only some embodiments and are not to be considered limiting in scope as there can be other equally effective embodiments.

FIG. 14 is a left side view of the pendant of FIGS. 10 and 11 at an initial stage of deployment.

FIG. 15 is a left side view of the pendant of FIGS. 10 and 11 at an intermediate stage of deployment.

The use of the same reference symbols in different drawings indicates similar or identical items.

DETAILED DESCRIPTION OF THE DISCLOSURE

Figure 1:
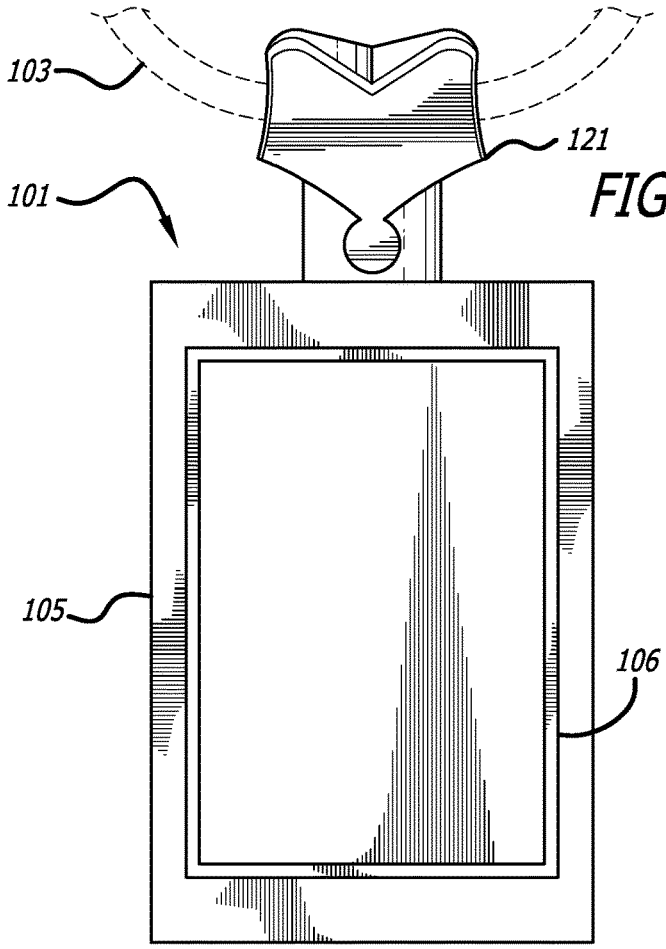
FIG. 1 is a front view of an embodiment of a pendant.
Figure 2:
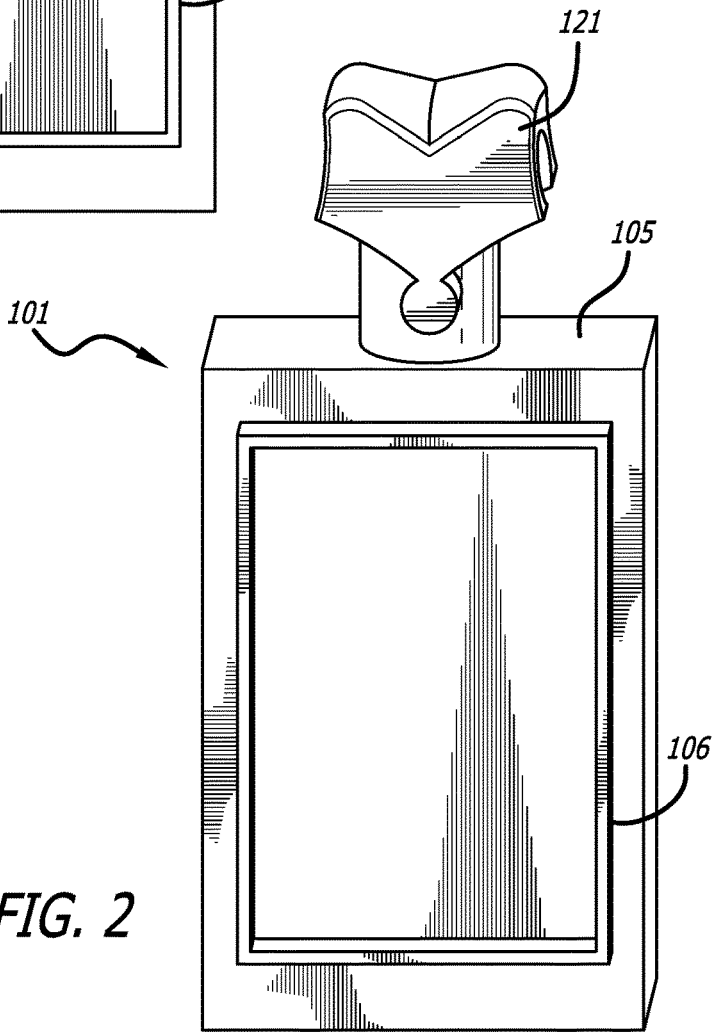
FIG. 2 is an isometric view of the pendant of FIG. 1.
Figure 3:
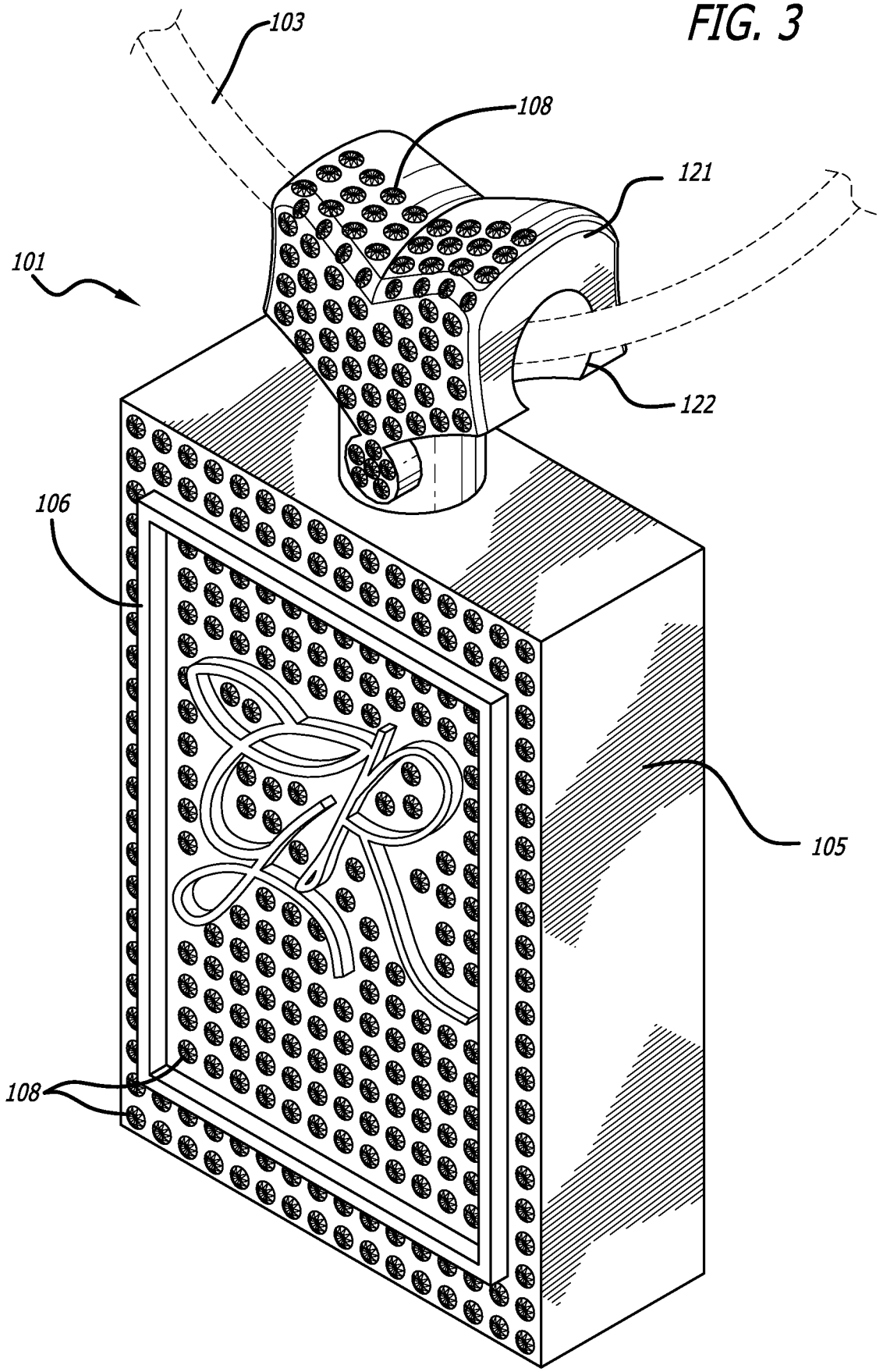
FIG. 3 is another isometric view of an alternate embodiment of a pendant.
Figure 4:
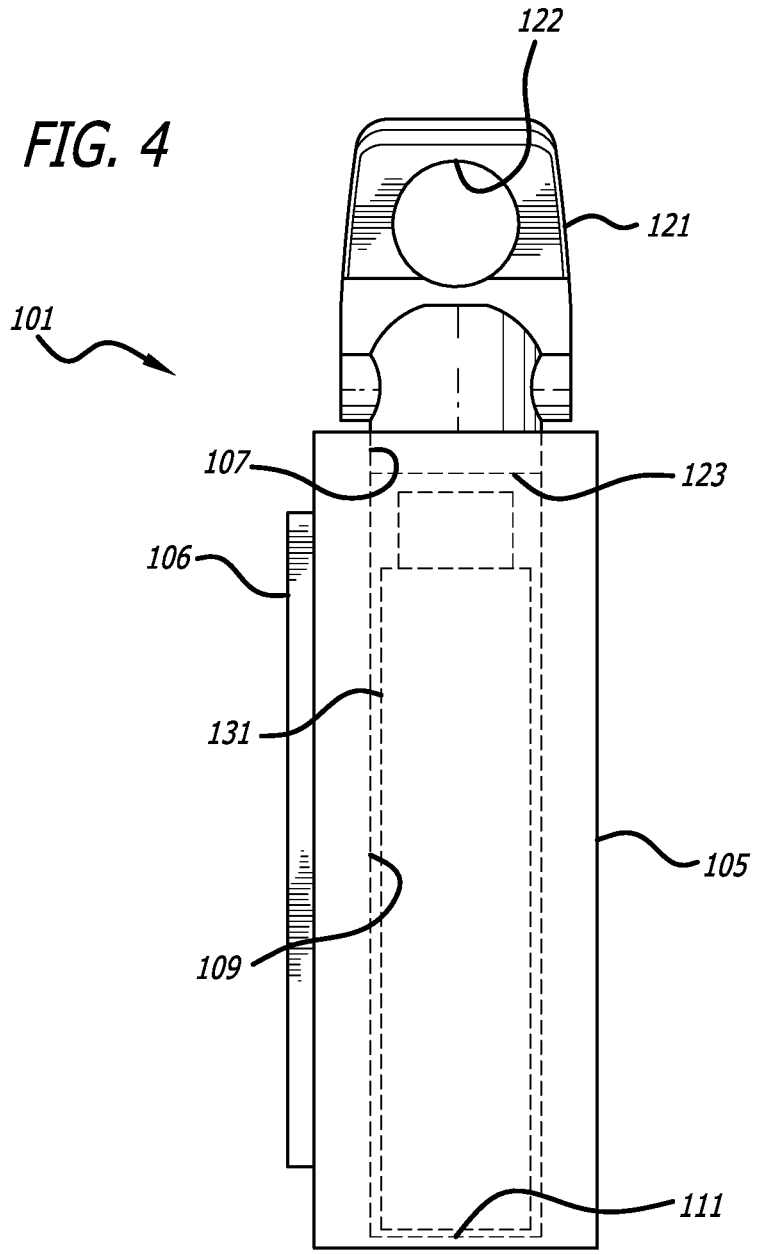
FIG. 4 is a right side view of the pendant of FIG. 1, showing an interior thereof in dashed lines.
Figure 5:
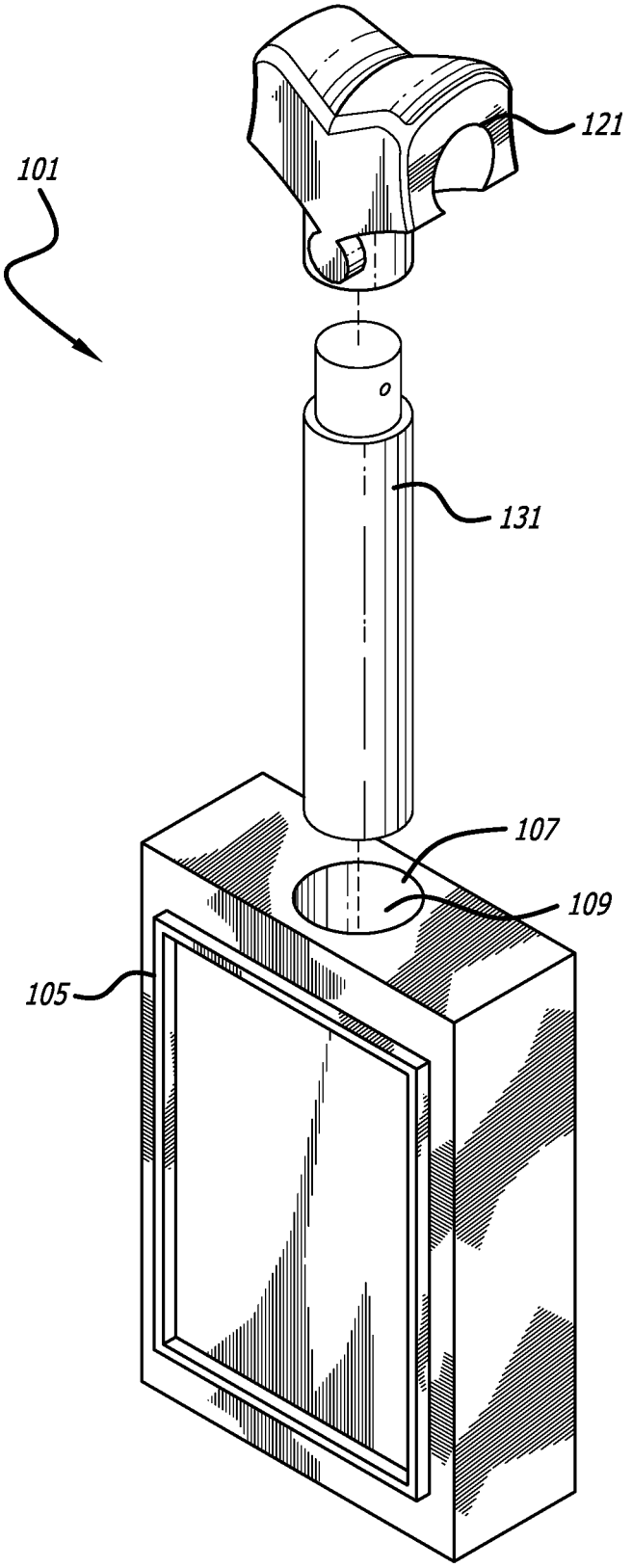
FIG. 5 is an exploded, isometric view of the pendant of FIG. 1.
Figure 6:
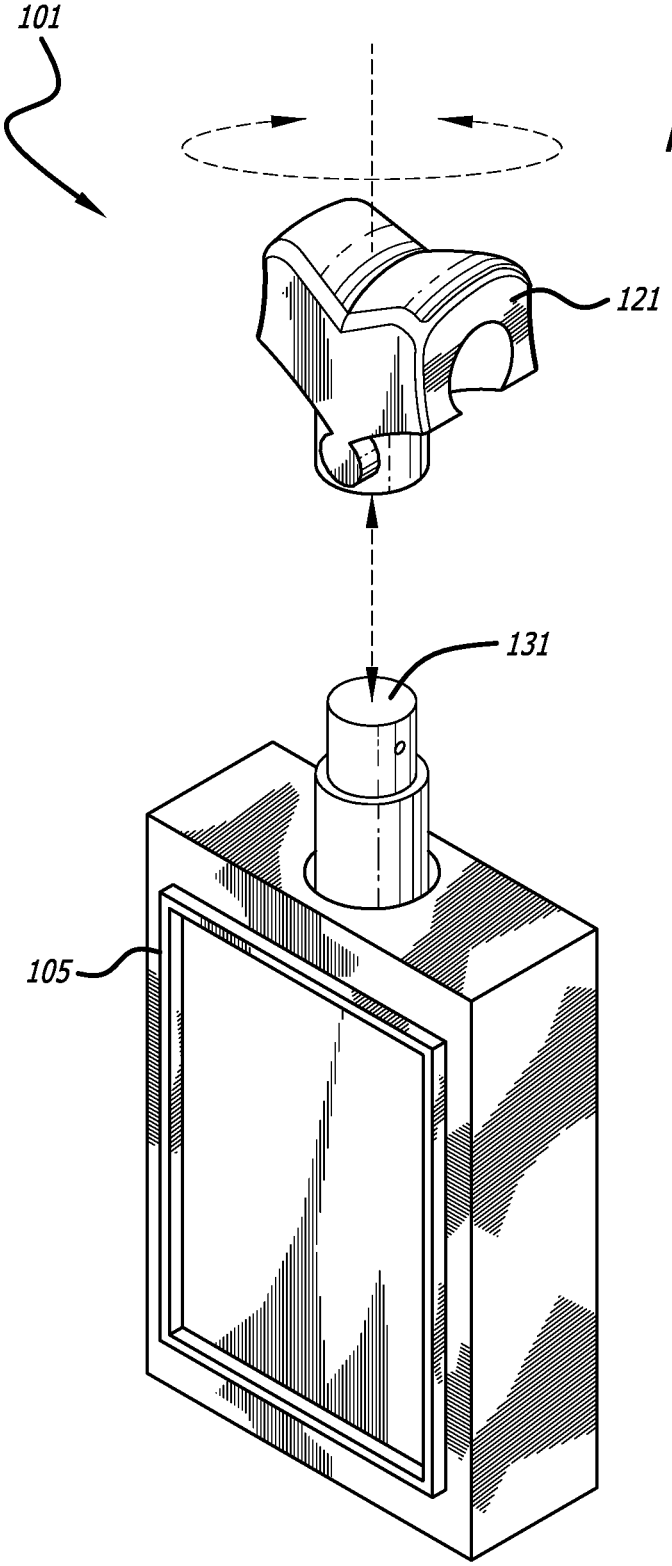
FIG. 6 is a partially exploded, isometric view of the pendant of FIG. 1.
Figure 7:
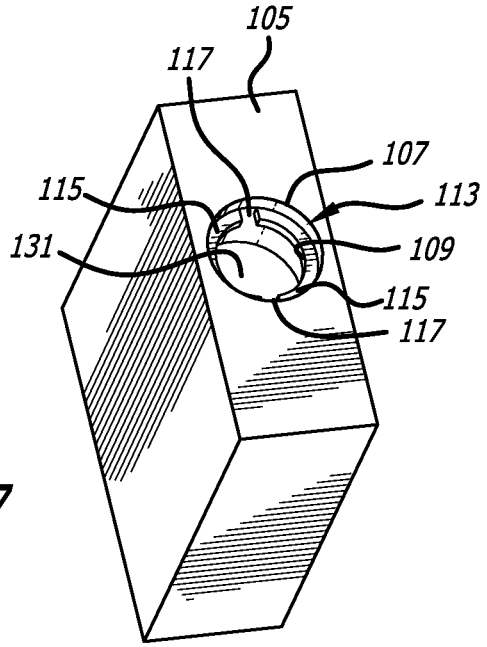
FIG. 7 is a top isometric view of an alternate embodiment of a body of the pendant.
Figure 8:
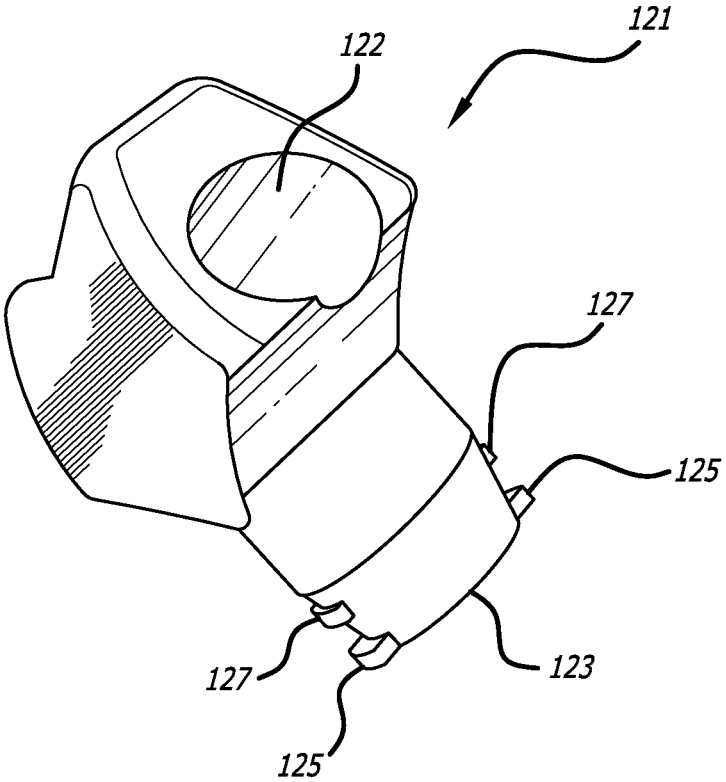
FIG. 8 is an isometric view of an embodiment of a lid for the pendant body of FIG. 7.
Figure 9:
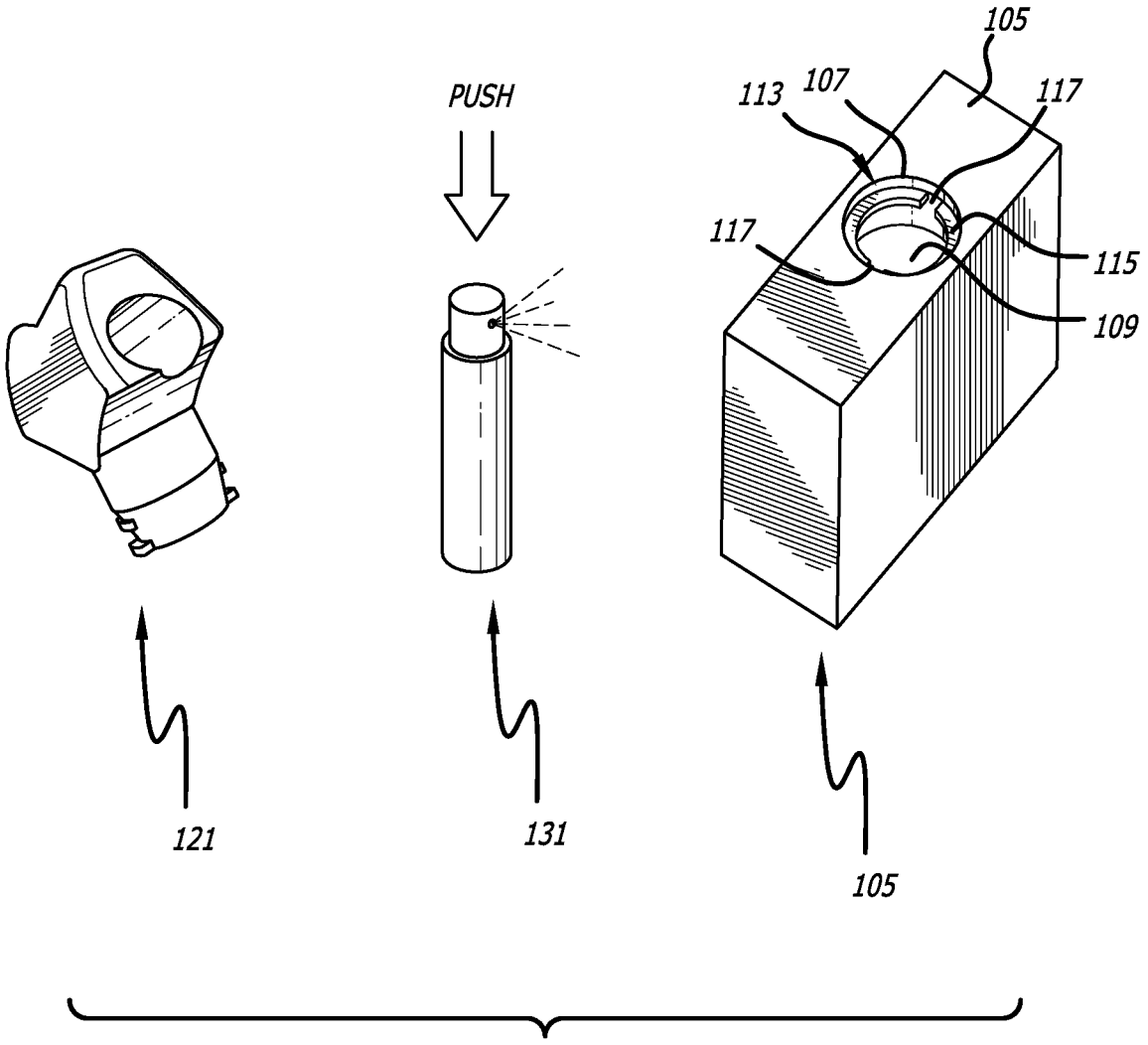
FIG. 9 is an isometric view of the lid, fragrance container and pendant body of FIGS. 7 and 8.

Embodiments of a necklace pendant having a deployable fluid container that can be hidden are disclosed in FIGS. 1-15. For example, FIGS. 1-6 disclose examples of a pendant 101 for a necklace 103 (shown in dashed lines in FIGS. 1 and 3). Versions of the pendant 101 can include a body 105 comprising an aperture 107 (FIGS. 4 and 5), and a hole 109 extending into the body 105 from the aperture 107. The aperture 107 and the hole 109 can be circular and cylindrical, respectively, and co-axial. In one example, the aperture 107 is a single external aperture and is the only aperture in the body 105, such that there are no other openings or apertures in the body 105. Embodiments of the hole 109 can terminate at a closed bottom 111 (FIG. 4, shown in phantom) within the body 105, to form a blind hole.

Some examples of the body 105 can include an exterior shape such as the rectangular block-like form shown. Other versions of the pendant 101, such as the body 105 or lid 121, can include other details such as the raised rectangular feature 106 shown on the front face of body 105, and the jewel or jewel-like encrustations 108 (FIG. 3) on one or more surfaces. Still other examples of the pendant 101 can be formed from various materials, such as stainless steel and/or plated with a precious metal, such as gold.

Versions of the pendant 101 can further include the lid 121, which can be configured to be removably mounted to the body 105. For example, the lid 121 and body 105 can be removably attached to each other with various mechanisms and techniques, such as mechanical interlocking features, threads, snap lock, press fit, magnets, etc. The lid 121 can be configured to be mounted to the necklace 103 (FIG. 1) via a through hole 122 in the lid 121 to support the body 105 therefrom. The lid 121 also can be co-axial with the aperture 107 and hole 109 when mounted to the body 105. Examples of the lid 121 can configured to be coupled to the body 105 to close the aperture 107 and hole 109. The lid 121 can be configured to be uncoupled from the body 105 to provide access to the aperture 107 and hole 109.

In addition, the pendant 101 can further include a container 131 (FIGS. 4-6) that is configured to be removably mounted in the body 105. Examples of the container 131 can include a cylindrical container, such as a manual pump dispenser. Such a dispenser can be configured to dispense a fluid as an aerosol or fragrance (e.g., perfume or cologne).

The container 131 can have a retained position (FIGS. 1-4) wherein the container 131 is inside the body 105 and/or a portion of the lid 121. The container 131 can be seated on the closed bottom 111 (FIG. 4) of the hole 109. The container 131 can be captured inside the body 105 beneath a bottom 123 of the lid 121 when the lid 121 is mounted to the body 105. In this position, the container 131 is configured to be stored and not actuated to dispense fluid. When lid 121 is removed from the body 105 (FIG. 5), the container 131 can further include a released position (shown partially released in FIG. 6, and completely released in FIG. 5) wherein the container 131 can be exposed and can be removed from the body 105 and located at least partially or completely outside the body 105. In this position, the container 131 is configured to be actuated and dispense fluid (see, e.g., FIG. 9).

In addition, embodiments of the body 105 can include a body coupling 113 (see, e.g., FIGS. 7-9) located adjacent to the aperture 107 and hole 109. The body coupling 113 can be located at or adjacent to a distal end of the hole 109 at or near the aperture 107. The body coupling 113 can be axially spaced apart from the aperture 107, as shown. In the illustrated example, the body coupling 113 can include one or more ribs 115 that can protrude radially inward from an inner surface of the body 105 that defines the hole 109. The ribs 115 can include opposing slots 117 that extend to the inner surface of the body 105. Different or other mechanical features also can be used to secure the lid 121 to the body 105.

Versions of the lid 121 can include the bottom 123 or axial lower end, which can be beveled as shown. The bottom 123 also can include adjacent protrusions 125 (FIG. 8) that can extend radially outward from the lid 121. The protrusions 125 can be configured to align with the slots 117 in the ribs 115 and extend through the slots 117 when the lid 121 is mounted to the body 105. Embodiments of the lid 121 can have shoulders 127 that are circumferentially aligned with the protrusions 125, but axially spaced apart from them. When the lid 121 is mounted to the body 105 and rotated, the ribs 115 can be captured by the lid 121 between the shoulders 127 and the protrusions 125 to secure the lid 121 from removal from the body 105. In one example, the lid 121 can be rotated about 90 degrees relative to the body 105 to secure the lid 121 to the body 105. In other versions, the range of rotation can be anywhere from at least about 5 degrees, to not greater than about 175 degrees.

Figure 10:
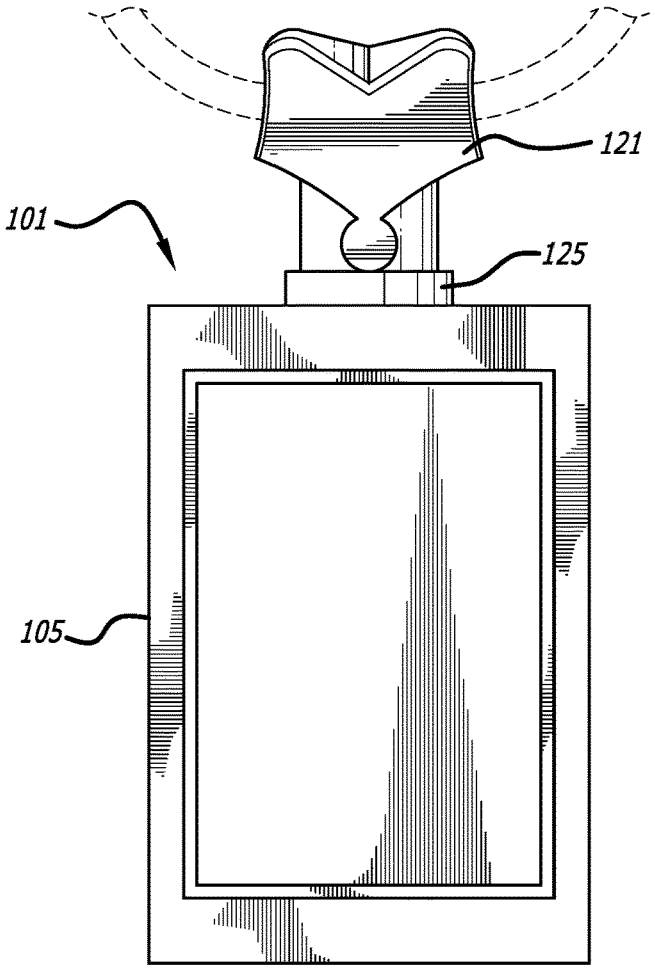
FIG. 10 is a front view of an alternate embodiment of a pendant.
Figure 11:
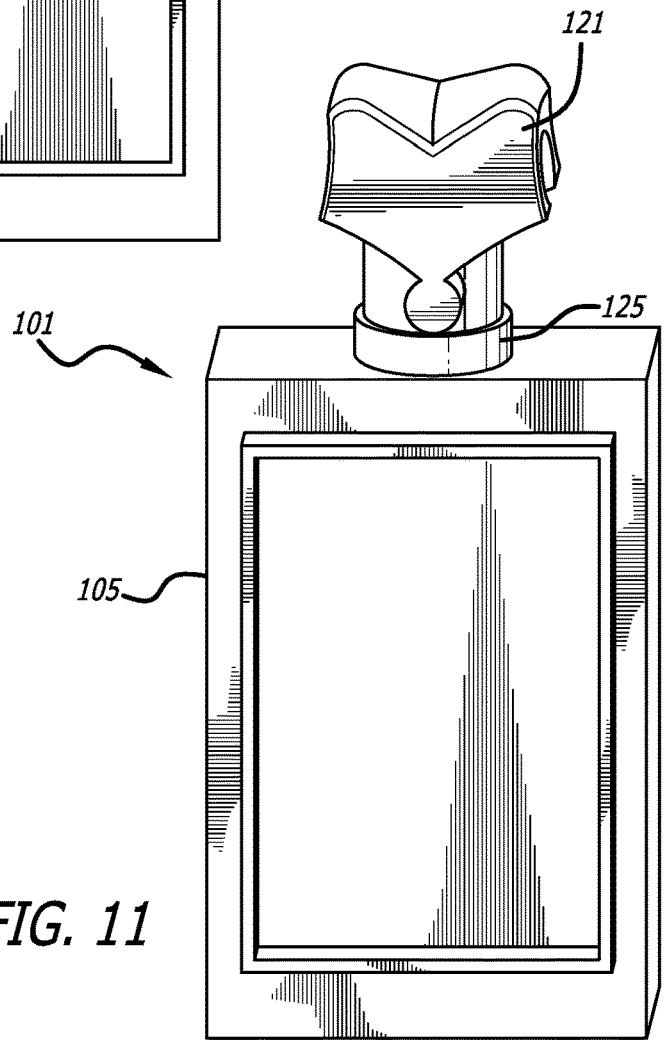
FIG. 11 is an isometric view of the pendant of FIG. 10.
Figure 12:
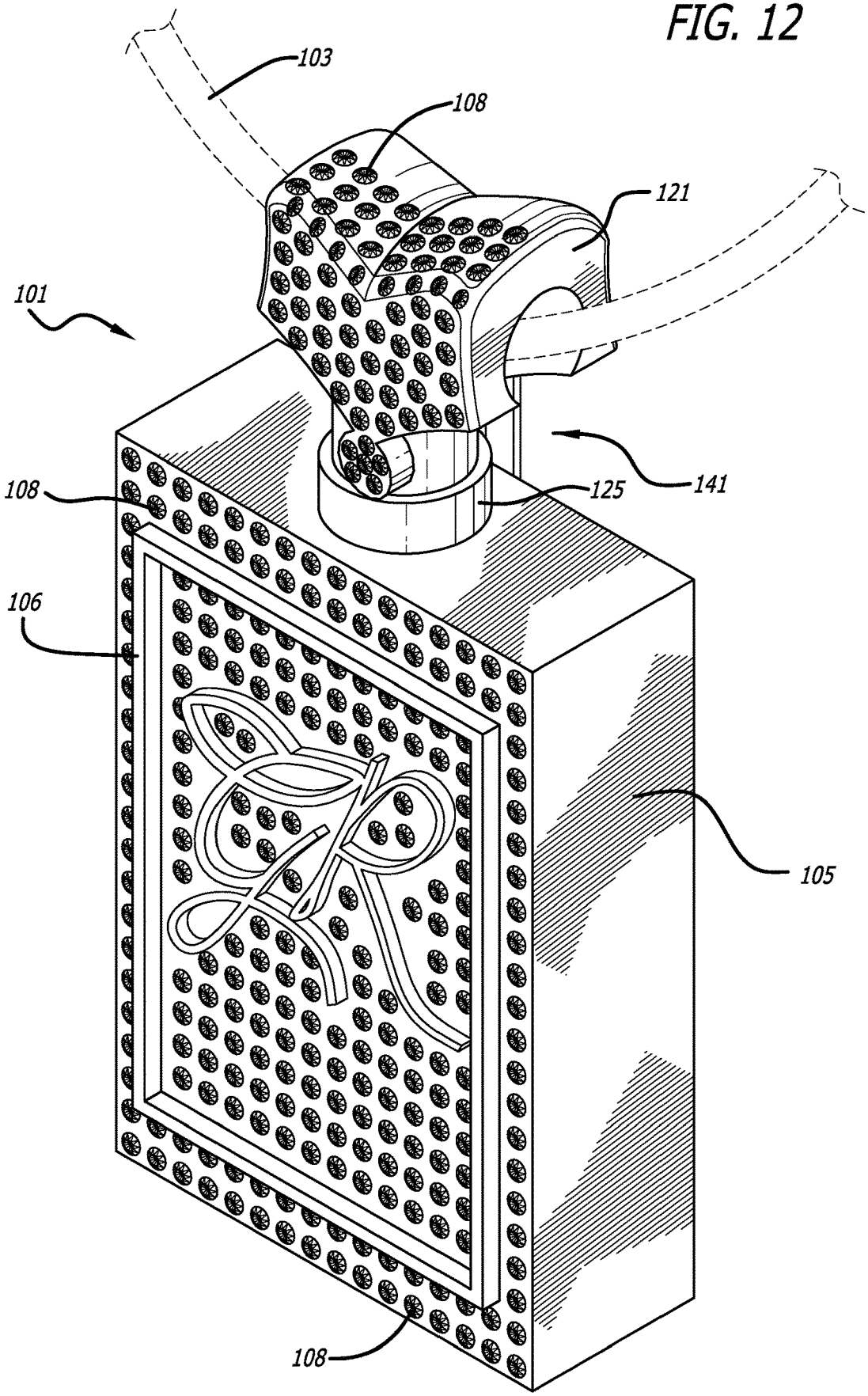
FIG. 12 is an isometric view of another embodiment of the pendant of FIGS. 10 and 11.

FIGS. 10 and 11 depict another embodiment of the pendant 101 having a lid 121 with an elongated neck and shoulder 125 on a distal end thereof. In some examples, shoulder 125 can provide a reinforced attachment mechanism to secure the lid 121 to the body 105, provide space for the container 131, etc.

The versions of FIGS. 12-15 can include the pendant 101 with any of the features, components and elements described herein. In addition, the pendant 101 can include a hinge assembly 141. The hinge assembly 141 can be used to couple the lid 121 to the body 105, as shown. For example, the hinge assembly 141 can include a body hinge 143 coupled to the body 105. The hinge assembly 141 also can include a lid hinge 145 coupled to the lid 121. A slide 147 can movably extend from a slide body 149. The slide 147 can comprise a linear slide that is linearly movable relative to the slide body 149.

Figure 13:
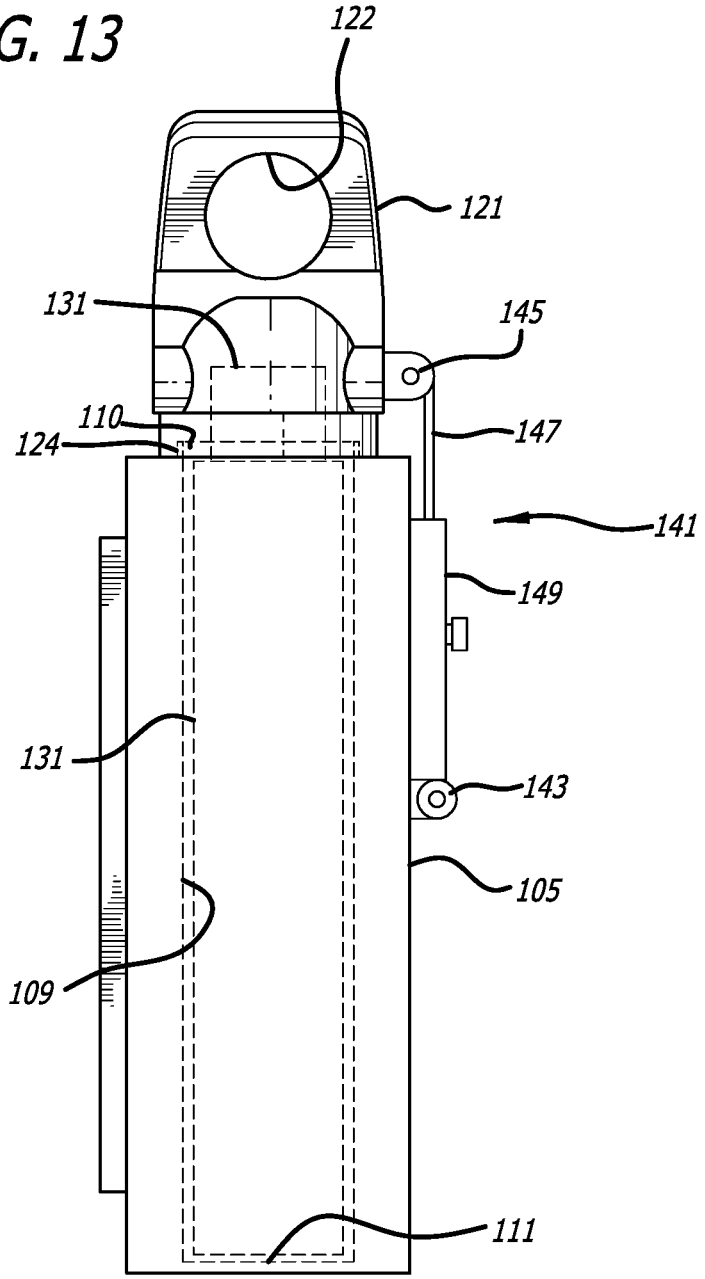
FIG. 13 is a left side view of the pendant of FIGS. 10 and 11.

In FIG. 13, the lid 121 can be mounted to the body 105, such as by press fit or snap fit. In an example, a rim 110 on body 105 can engage a lip 124 inside the lid 121. In some embodiments, the container 131 can be captured and located inside both lid 121 and body 105, as shown. In some versions, the container 131 cannot be actuated in this position and no fluid can be release or detected.

In FIG. 14, the lid 121 is removed from body 105 as shown by the vertical arrow, such that the slide 147 begins to exit the slide body 149. In an example, the slide 147 can have a limited range of egress from slide body 149, such that the lid 121 can be always coupled to the body 105, whether directly or indirectly.

In FIG. 15, the lid 121 is shown in a further articulated position. For example, the slide body 149 can pivot about body hinge 143 relative to body 105. In another example, the lid 121 can pivot about the lid hinge 145 relative to the slide 147. These positions can enable the container 131 to be actuated to release at least some of its fluid contents, as desired.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. As used herein, the terms "substantial" and "substantially" means, when comparing various parts to one another, that the parts being compared are equal to or are so close enough in dimension that one skill in the art would consider the same. Substantial and substantially, as used herein, are not limited to a single dimension and specifically include a range of values for those parts being compared. The range of values, both above and below (e.g., "+/−" or greater/lesser or larger/smaller), includes a variance that one of skill in the art would know to be a reasonable tolerance for the parts mentioned.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or essential feature of any or all the claims.

After reading the specification, skilled artisans will appreciate that certain features which, for clarity, are described herein in the context of separate embodiments, can also be provided in combination in a single embodiment. Conversely, various features that are, for brevity, described in the context of a single embodiment, can also be provided separately or in any subcombination. Further, references to values stated in ranges include each and every possible value within that range.

What is claimed is:

1. A pendant and necklace, comprising:

a body comprising an aperture, a hole extending into the body from the aperture, the hole terminating at a closed bottom within the body, and a body coupling located adjacent to the aperture;

a lid configured to be attached to and detached from the body, the lid mounted to a necklace to support the body therefrom, the lid comprising a lid coupling configured to be coupled to the body coupling to close the aperture, the lid coupling configured to be uncoupled from the body coupling to provide access to the hole, and the lid having a through hole receiving the necklace; and a container configured to dispense a fragrance contained therein, the container configured to be removably mounted in the body, the container having a retained position wherein the container is seated on the closed bottom of the hole and captured inside the body by the lid when the lid is mounted to the body, such that the container cannot dispense the fragrance in the retained position, and the container having a released position wherein the lid is detached from the body such that the container is at least partially exposed from the body, such that the container can dispense the fragrance in the released position;

wherein the pendant comprises a hinge assembly configured to couple the lid to the body, the hinge assembly comprising:

a slide configured to seat in and movably extend from a slide body;

a body hinge coupled to the body and the slide body; and a lid hinge coupled to the lid and the slide;

wherein the slide body is configured to pivot about the body hinge relative to the body, and wherein further the lid is configured to pivot about the lid hinge relative to the slide.

2. The pendant and necklace of claim 1, wherein the aperture is a single external aperture and is the only aperture in the body, such that there are no other openings or apertures in the body.

3. The pendant and necklace of claim 1, wherein the hole is a cylindrical hole and the container is a cylindrical container.

4. The pendant and necklace of claim 1, wherein the aperture and the hole are co-axial, and the lid also is co-axial when mounted to the body.

5. The pendant and necklace of claim 1, wherein the body coupling comprises a rim that circumscribes the aperture and extends axially from the body.

6. The pendant and necklace of claim 5, wherein the lid coupling comprises an inner lip inside the lid configured to engage the rim of the body coupling.

7. The pendant and necklace of claim 6, wherein the lid is configured to be secured to the body by press fit or interference fit.

8. The pendant and necklace of claim 1 wherein, in the retained position, the container is captured and located inside both the body and the lid.

9. The pendant and necklace of claim 8, wherein the slide has a limited range of egress from the slide body, such that the lid is always coupled to the body, whether directly or indirectly.

10. The pendant and necklace of claim 1, wherein the container comprises a pump spray dispenser that is configured to be manually actuated to dispense the fragrance.

11. The pendant and necklace of claim 1, wherein the aperture is a single external aperture and is the only aperture in the body, such that there are no other openings or apertures in the body.

12. The pendant and necklace of claim 11, wherein the body coupling comprises a rim that circumscribes the aperture and extends axially from the body, the lid coupling comprises an inner lip inside the lid configured to engage the rim of the body coupling, and the lid is configured to be secured to the body by press fit or interference fit.

* * * * *